US010383433B1

(12) United States Patent
Guglielmi

(10) Patent No.: US 10,383,433 B1
(45) Date of Patent: Aug. 20, 2019

(54) EXPANSIBLE TABLE

(71) Applicant: Arda Co. Ltd., Binh Duong (VN)

(72) Inventor: Stelvio Guglielmi, Binh Duong (VN)

(73) Assignee: Arda Co. Ltd. (VN)

( * ) Notice: Subject to any disclaimer, the term of this patent is extended or adjusted under 35 U.S.C. 154(b) by 93 days.

(21) Appl. No.: 15/819,586

(22) Filed: Nov. 21, 2017

Related U.S. Application Data

(60) Provisional application No. 62/433,313, filed on Dec. 13, 2016, provisional application No. 62/425,243, filed on Nov. 22, 2016.

(51) Int. Cl.
*A47B 1/03* (2006.01)

(52) U.S. Cl.
CPC ..... *A47B 1/03* (2013.01); *A47B 2001/035* (2013.01)

(58) Field of Classification Search
CPC ..... A47B 1/03; A47B 2001/035; A47B 13/10
USPC .. 108/66, 67, 70, 71, 73, 76, 65, 72, 83–86, 108/68
See application file for complete search history.

(56) References Cited

U.S. PATENT DOCUMENTS

| | | | | |
|---|---|---|---|---|
| 254,388 | A | 2/1882 | Shultz | |
| 340,176 | A | 4/1886 | Wardwell, Jr. | |
| 351,101 | A | 10/1886 | Fauber | |
| 838,671 | A | 12/1906 | Turner | 108/66 |
| 1,547,685 | A | 7/1925 | Rhodes | |
| 1,853,527 | A | 4/1932 | Wurm | 108/67 |
| 2,205,274 | A * | 6/1940 | Rastetter | A47B 1/03 108/67 |
| 4,646,653 | A | 3/1987 | Balbiu et al. | 105/406.1 |
| 4,794,869 | A | 1/1989 | Chiu | 108/86 |
| 5,156,095 | A | 10/1992 | Hansbaek et al. | 108/66 |
| 5,237,937 | A | 8/1993 | Peltier et al. | 108/66 |
| 6,009,814 | A | 1/2000 | Rossi | 108/66 |
| 6,994,032 | B2 | 2/2006 | Conley et al. | 108/65 |
| 7,311,047 | B2 | 12/2007 | Conley et al. | 108/65 |
| 7,464,653 | B2 | 12/2008 | Dodge | 108/86 |
| 2004/0194672 | A1 | 10/2004 | Conley et al. | 108/83 |
| 2006/0075940 | A1 | 4/2006 | Dodge | 108/86 |
| 2006/0124037 | A1 | 6/2006 | Conley et al. | 108/83 |
| 2009/0050032 | A1 * | 2/2009 | Conley | A47B 1/056 108/66 |

FOREIGN PATENT DOCUMENTS

| | | |
|---|---|---|
| CH | 514312 | 4/1970 |
| DE | 2545160 | 4/1977 |
| DE | 8905882 | 11/1989 |

(Continued)

OTHER PUBLICATIONS

International Preliminary Report on Patentability, dated Apr. 17, 2007, PCT/IB2005/004066, The International Bureau of WIPO, Switzerland.

(Continued)

*Primary Examiner* — Janet M Wilkens
(74) *Attorney, Agent, or Firm* — MacCord Mason PLLC

(57) ABSTRACT

A Jupe-style radial expansion table has a centerpiece with radial slots in its top. The expansion leaves of the table have pins on centermost parts of the leaves that extend into the slots in the top of a table centerpiece to center the leaves as they deploy. Wedges on the bottoms of the inner leaf segments of the expansion leaves help guide the inner leaf segments on a trajectory toward the centerpiece.

19 Claims, 14 Drawing Sheets

(56) References Cited

FOREIGN PATENT DOCUMENTS

| | | | |
|---|---|---|---|
| FR | 319351 | * 11/1902 | |
| GB | 6788 | 9/1835 | |
| GB | 5354 | 10/1902 | |
| GB | 30248 | 12/1910 | |
| GB | 0230120.8 | 12/2002 | ..... 1/5 |
| GB | 2431572 | 2/2007 | ..... 1/3 |
| WO | 2004/089158 | 10/2004 | ..... 1/3 |
| WO | WO 2006/030159 | 3/2006 | ..... 13/8 |
| WO | WO 2006/092664 | 9/2006 | |

OTHER PUBLICATIONS 601-306 Radial Expansion Table, The Oscar de la Renta Home Collection, Century Furniture Industries, website printout, 2004.
Ilona Radially Expanding Table, David Fletcher, website printout, 2004.
Schwartz, Radially Expanding Table, David Fletcher, website printout, 2004.
Patent Cooperation Treaty, Written Opinion of the International Searching Authority, dated Oct. 19, 2006, pp. 1-13, European Patent Office.
Expandable Table Version Prior to Utility Patent Application ARDA pp. 1-7.

* cited by examiner

EXPANSIBLE TABLE

BACKGROUND OF THE INVENTION

The present invention relates to an improvement in Jupe-type expansible tables. Radial or round tables have been used for centuries for dining and other purposes. Several designers have attempted approaches to allow a user to increase the surface area of radial tables, in particular. In one quite famous solution, around 1835, Robert Jupe developed a radial table containing sections that diverge from a common center to allow for insertion of expansion leaves.

More recently, Martin Dodge was granted U.S. Pat. No. 7,464,653 on a radial table. In the Dodge table, table top sections could be pulled radially outwardly, exposing expansion leaves that were anchored to the table under the table top sections by double hinges. The entire disclosure of that patent is incorporated herein by reference. The expansion leaves could deploy to fill the space between the table top sections. As shown in the Dodge patent and FIG. 1 of this application, a radial table 10 has a pedestal 20, table base 30 and a top made up of six similarly-dimensioned table top sections 40. FIG. 1 shows table 10 in its first position, which coincides with the smallest table top surface area.

As shown in the Dodge patent and in FIGS. 2 and 3 of this application, to enlarge the radial table, the table top sections 40 are pulled radially outward from the center. A stop (not shown) beneath each table top section 40 limits the outward travel of the table top section. The table top sections of the Dodge patent move or glide on rails 42 that are mounted on the floor of the bottom 32, and can have a mating protrusion (not shown) on the underside of the table top sections 40 to engage the rails 42. (It is also known to have the table top sections equipped with protrusions that ride in channels mounted on the bottom 32, instead of the assembly using rails 42, so both forms of construction to constrain the table top sections' movement are known.)

Pulling the table top sections 40 radially outwards exposes expansion leaves 50 between the table top sections 40. In an embodiment as shown in FIG. 3, each leaf 50 comprises an inner panel 54 and an outer panel 55. The panels 54 and 55 are joined by invisible hinges 65. In the embodiment shown, six (6) expansion leaves 50 are used.

The Dodge patent has the panels 54 anchored to the table by double hinges. When expansion of the table is desired, the outer panels 55 are pivoted outwardly until the combination of the panels 54 and 55 become planar, and the panels 54 and 55 are shifted toward a central support, or hub, 80 also shown in FIGS. 2 and 3, which supports the innermost points of the inner panels 54.

Similar constructions of table tops, using radially expandable sections with underlying deployed expansion leaves have become popular, generally differing from the mechanism of the Dodge disclosure by the mechanism that enables deployment of the expansion leaves.

For example, in the structure shown in FIGS. 4A through 4F and FIGS. 5A through 5C, a table panel 60 includes radially-extending rails 62. The expansion leaves 64 are made up of an inner segment 66 and an outer segment 68. Pins 70 extend outward from the sides of the outer segment 68 into slots 72 in the rails 62. The pins 70 are held to the outer leaf segments by brackets, as shown.

As can be seen in FIG. 4A, each expansion leaf is stored below the top of the rail 62, so that the table top sections, which are at a height above the top 71 of the rail 72 are positioned over the expansion leaves 64 when the expansion leaves are not in use. The table panel 60 has a centerpiece 86 with radial projections 88 on its top, surrounded by a guide surface 90. See FIGS. 5A through 5C. The inner, pointed end 94 of the inner segment 66 of the expansion leaf has a radial slot 96 as seen in FIG. 4F, so that a projection 88 of the centerpiece can fit into the radial slot 96 when the leaf is properly positioned.

Deployment of the expansion leaves involves pulling the outer segment of the expansion leaf upward and outward. This causes the pivoting of the outer segment 68 around the pins 70, until the expansion leaf is above the slot 72 in the rail so the expansion leaves reach the same height as the table top sections. (See the progression in FIGS. 4A through 4E.) The inner, pointed end 94 of the expansion leaf is aimed toward the centerpiece 86 so the projection 88 can be lodged in the radial slot 96. However, users of the table configuration of FIGS. 4A through 4F and FIGS. 5A through 5C sometimes encountered difficulties in deploying the expansion leaves of the table, and in some cases damaged the table in the process, creating a need for an improved leaf deployment mechanism.

SUMMARY OF THE INVENTION

The present invention fulfills one or more of these needs in the art by providing a table including a table base including a pedestal to rest on a floor. A panel of the table base defines a panel height. A plurality of table top sections mounted in channels or on rails that are on the panel enable radial movement of the table top sections from an inner position in which the plurality of table top sections become adjacent to make a full, but smaller, table top to an outer position in which the table top sections are spaced from one another. Mounts on the panel rise above the panel height to a mount height below the table top sections, and each mount has a slot below the mount height. A plurality of expansion leaves are unattached to one another, and each of them is formed of inner and outer leaf segments joined end-to-end by a hinge, so each expansion leaf has a folded configuration and a deployed configuration. The inner leaf segment of each expansion leaf has a pointed end away from the hinge, and the pointed end has a downward-extending pin. Two side edges of the outer leaf segment of the each expansion leaf each have an outward-extending pin received in the slot of one of the mounts. A table centerpiece on the panel has radial slots in its top. When the table top sections are moved to their outer positions, the expansion leaves may each be moved from the their folded configuration to their deployed configuration by unfolding the outer leaf segment and pivoting it outward around the outward-extending pin, which guides the pointed end of the inner leaf segment toward the table centerpiece, positioning the downward-extending pin in one of the radial slots in the table centerpiece. The table top sections can then be moved radially inward to make a larger, full table top in combination with the expansion leaves.

The mount on the panel is usually a rail, but it could take other forms such as a stanchion. When the expansion leaves are in their folded configuration, they are stored under the table top sections as the table top sections make a full table top. The expansion leaves have a stored length and an installed length when the leaves are positioned coplanar to the table top sections, the stored length being greater than the installed length.

The panel of the table preferably has a peripheral edge and the inner leaf segments have wedges that bear against the outer edge of the panel during deployment to guide the inner leaf segment on an inclined path toward the centerpiece.

Typically, there are six table top sections and six expansion leaves.

The pointed end of each inner leaf segment of each expansion leaf may have magnets on its sides, so the pointed ends are attracted to one another when they are in their deployed configuration. Similarly positioned magnets may also be installed on the inner tips of the table top sections.

BRIEF DESCRIPTION OF THE DRAWINGS

The invention will be better understood by a reading of the Detailed Description of the Examples of the Invention along with a review of the drawings, in which.

DETAILED DESCRIPTION OF EXAMPLES OF THE INVENTION

Figure 1:
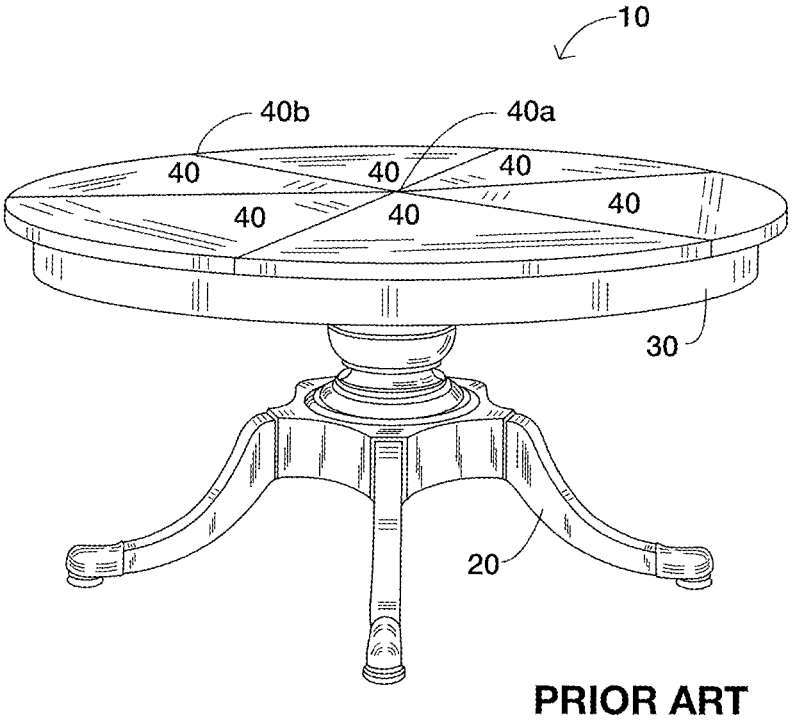
FIG. 1 is a perspective view of a table with a table base, as known in the prior art.
Figure 2:
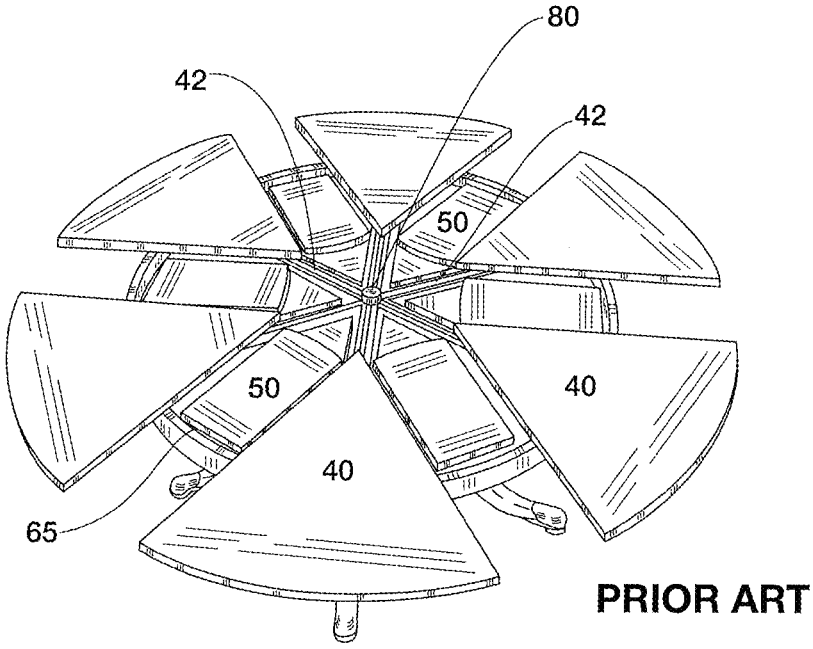
FIG. 2 is a top perspective view of the prior art table of Figure lwith table top sections moved outward so they do not touch each other.
Figure 3:
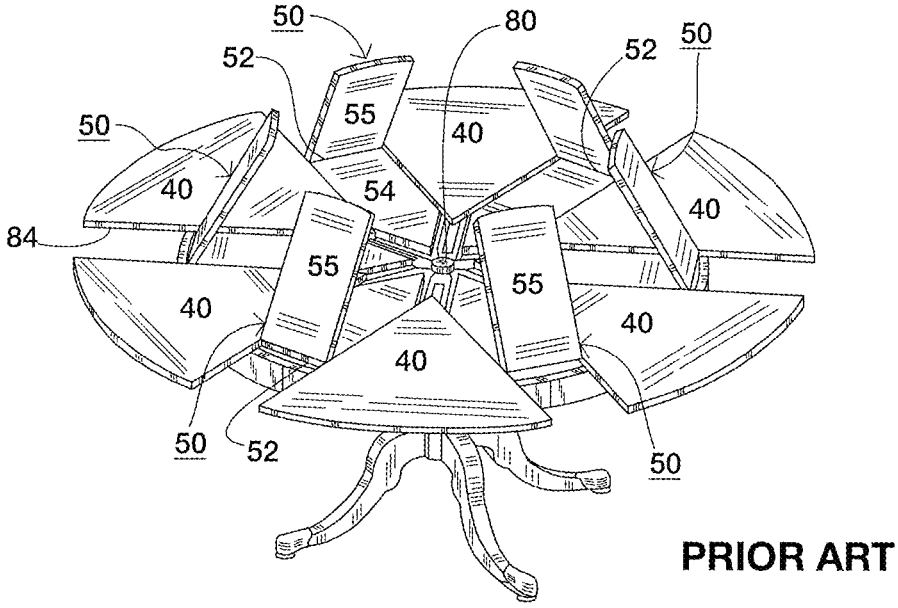
FIG. 3 is a top perspective view of the prior art table of FIG. 2, with folding expansion leaves in the process of expanding.
Figure 4A:
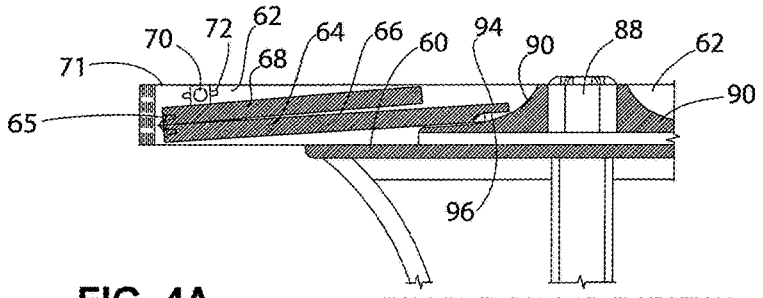
FIGS. 4A through 4E are side sectional views of the expansion leaves of another prior art table in the process of expanding.
Figure 4B:
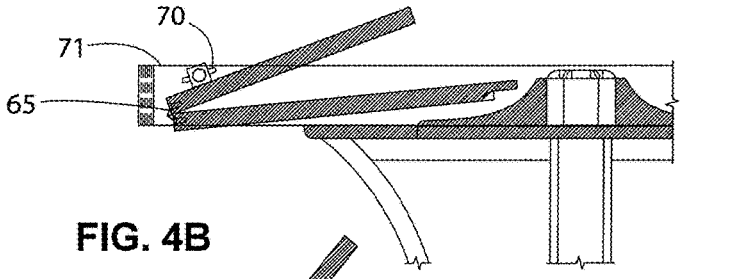
Figure 4C:
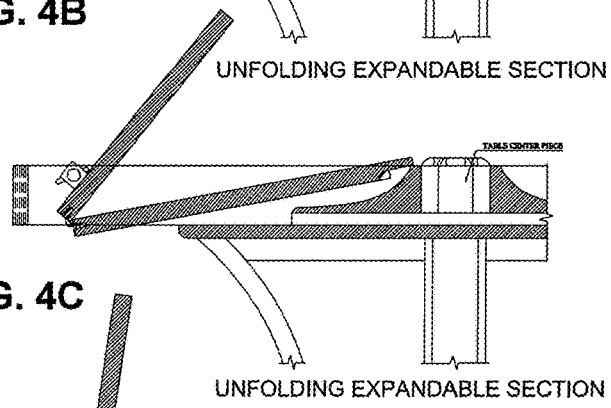
Figure 4D:
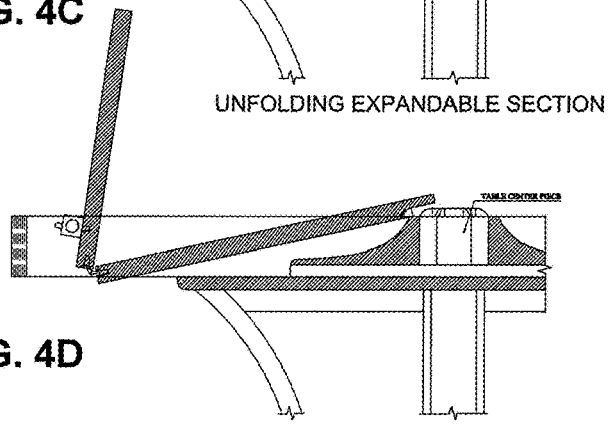
Figure 4E:
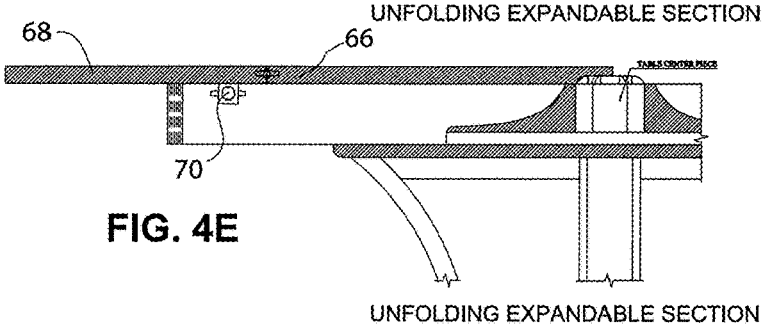
FIG. 4E PRIOR ART
Figure 4F:
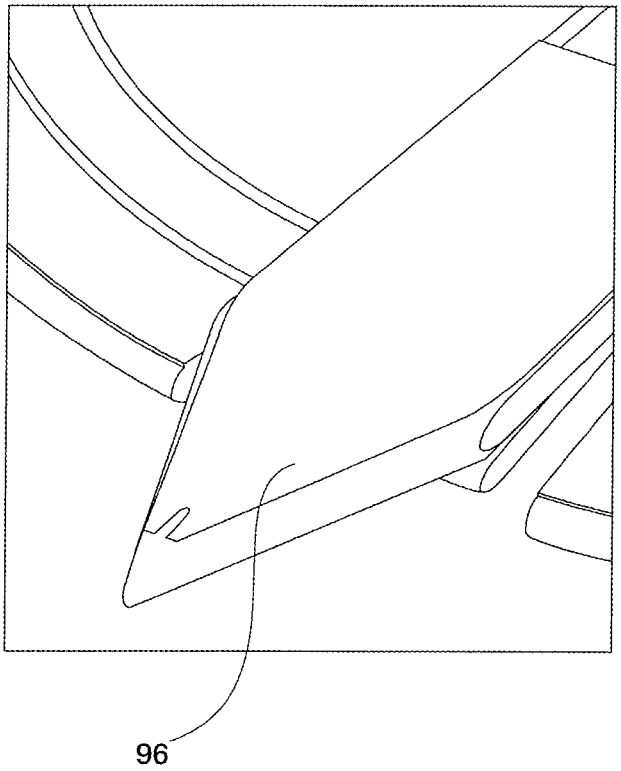
FIG. 4F PRIOR ART
FIG. 4F is perspective view of the bottom side of one of the inner leaf segments of the prior art table of FIGS. 4A through 4E.
Figure 5B:
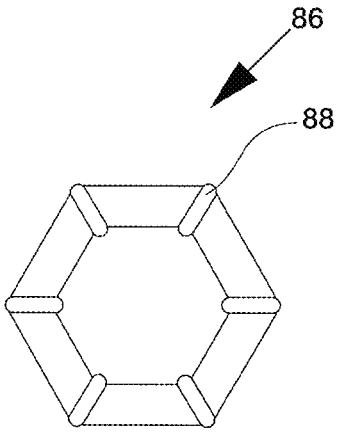
FIGS. 5A through 5C are perspective, top and side views respectively of a centerpiece of the table of FIGS. 4A through 4F.
Figure 5A:
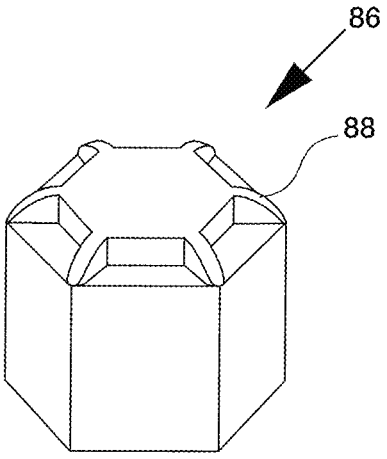
Figure 5C:
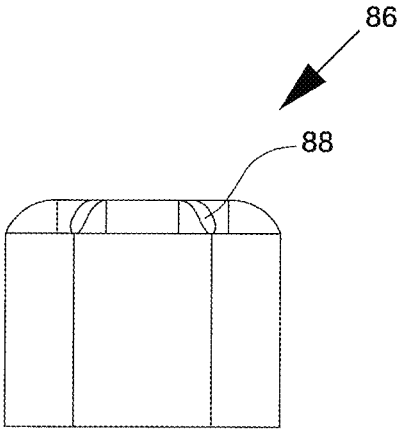
FIG. 5C PRIOR ART
Figure 10:
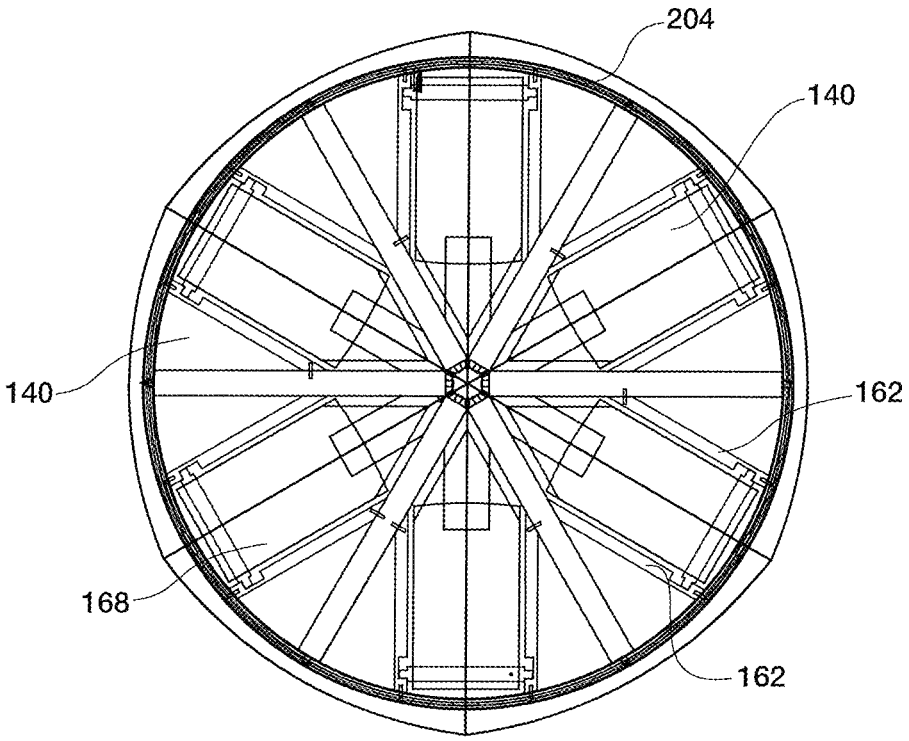
FIG. 10 is a top schematic view of a table in accordance with the invention in its smaller configuration.
Figure 11:
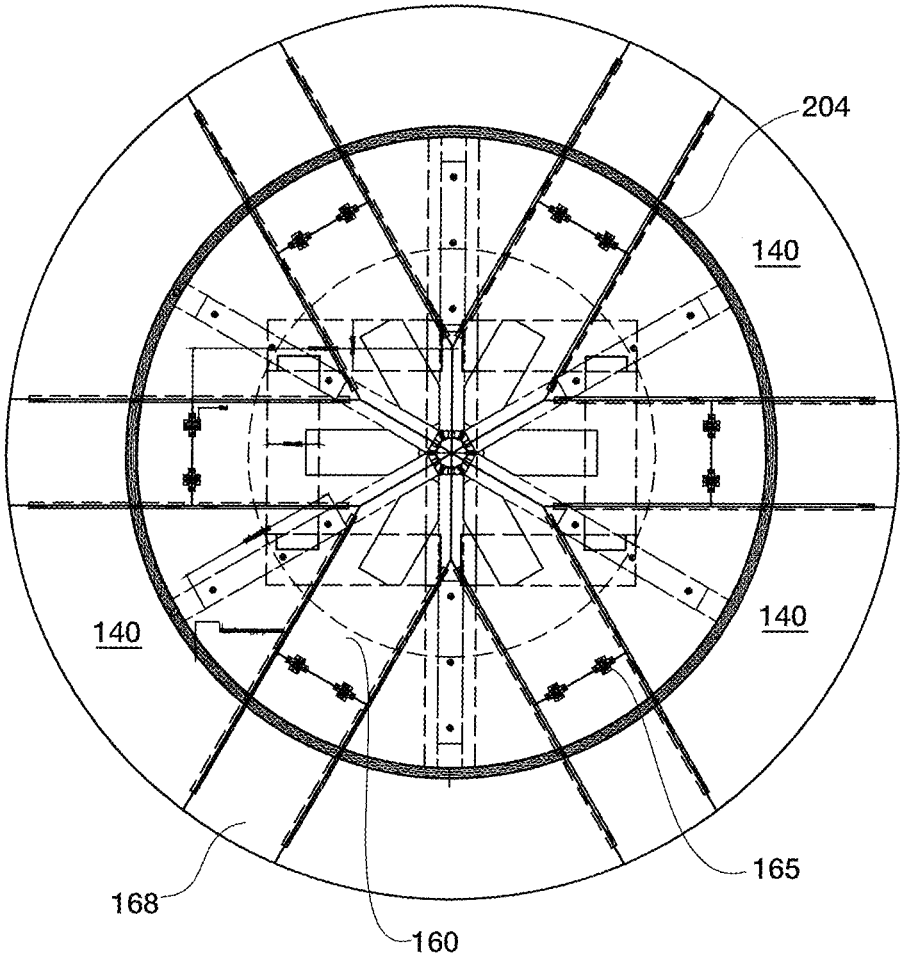
FIG. 11 is a top schematic view of a table in accordance with the invention in its larger configuration.
Figure 12:
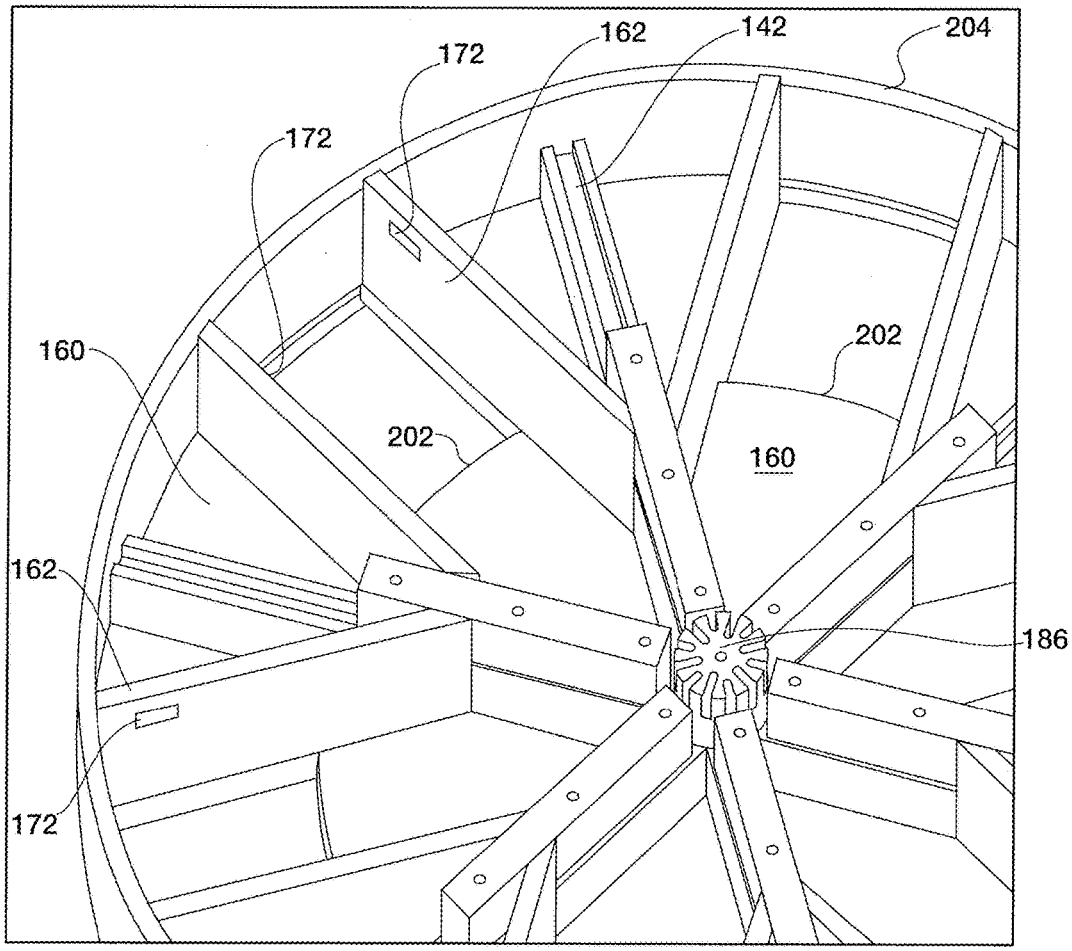
FIG. 12 is a perspective view of the panel of the table, with channels for the table top sections, rails and an outer skirt.

The invention is implemented in a table like those described above with respect to FIGS. 1 to 3, with modifications to the configuration and deployment of the expansion leaves. Expansion leaves in accordance with the invention are seen in FIGS. 6A through 12. As in the tables previously discussed, the leaves are mounted in the table with a table base including a pedestal to rest on a floor. A panel 160 of the table base defines a panel height. As seen in FIGS. 10 and 11, six table top sections 140 are mounted to the panel capable of radial movement of the table top sections from an inner position shown in FIG. 10 in which the plurality of table top sections become adjacent to make a smaller full table top to an outer position spaced from one another as seen in FIG. 11. FIG. 11 also shows expansion leaves 164 deployed to complete the larger table top. The table top sections 140 can be mounted to slide on rails or in channels 142 (as seen in FIG. 12), or other suitable configuration.

In the structure shown in FIGS. 6A through 12, a table panel 160 supports mounts such as radially-extending rails 162 that have slots 172. One leaf is seen in each of FIGS. 6A through 6E and is exemplary of all of expansion leaves of the table. Other mounts could be substituted for the rails 162, such as stanchions that locate the slot 172 appropriately but do not extend the full radial length of the rails 162 as shown. The expansion leaves 164 have inner segments 166 and outer segments 168. Pins 170 extend outward from the sides of the outer segment 168 into slots 172 in the rails 162. The pins 170 are secured to the bottom surface (as seen in FIG. 6E) of outer segment 168 by a bracket or other suitable means. The slots 172 allow for limited radial movement of the expansion leaf to align radially inwardly and outwardly. A user manipulating the expansion leaf causes the radial movement, but the movement is slight enough not to be noticeable.

Figure 6A:
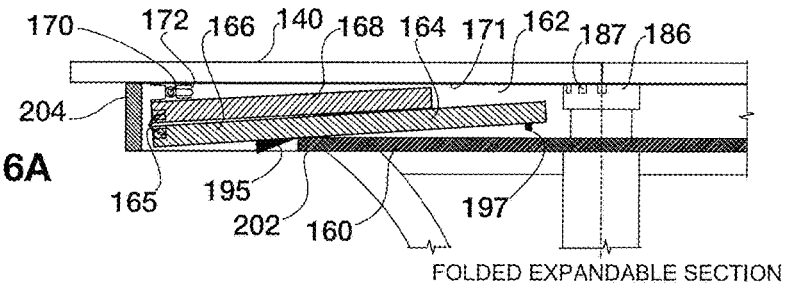
FIGS. 6A through 6E are side sectional views of expansion leaves of a table in accordance with the invention in the process of expanding.
Figure 6B:
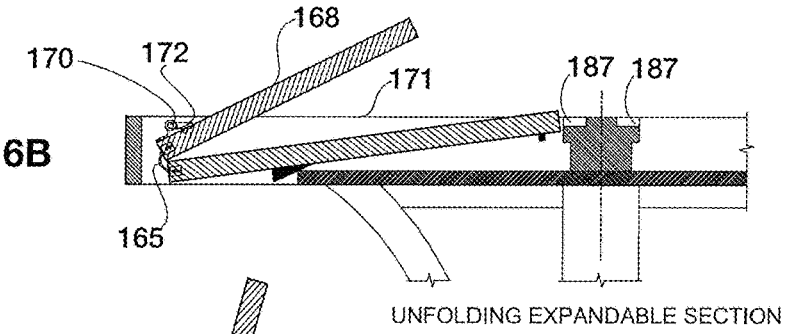
Figure 6C:
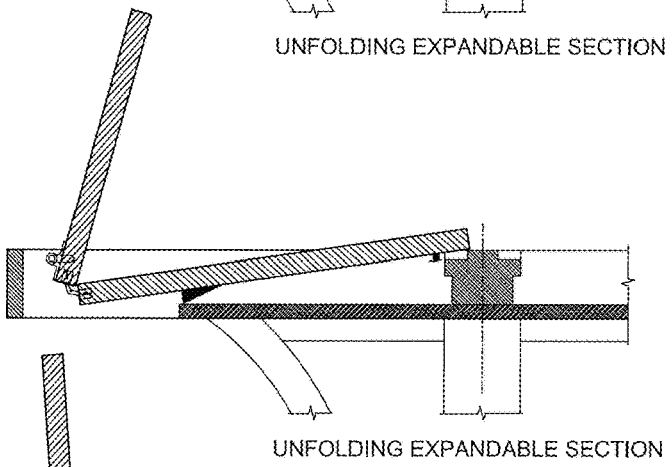
Figure 6D:
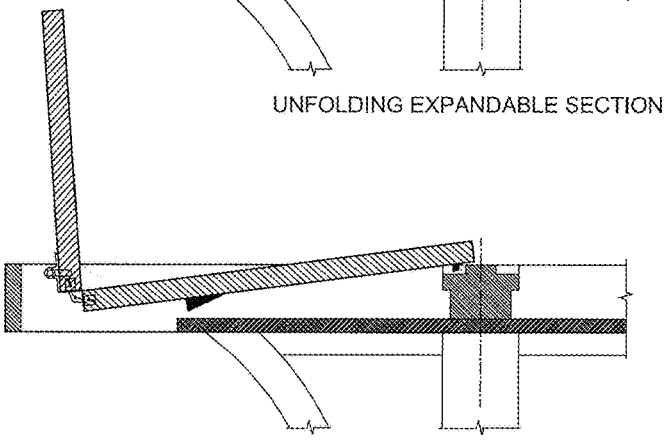
Figure 6E:
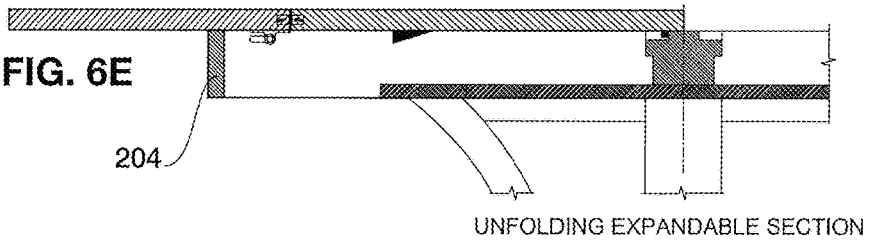

As can be seen in FIG. 6A, the expansion leaf is stored below the top of the rail 162, so that the table top sections that are at a height above the top 171 of the rail 162 are positioned over the expansion leaves 164 when the expansion leaves are not in use. The table panel 160 also has a centerpiece 186 with slots 187 in its top. (See especially FIGS. 9A through 9C.)

The table centerpiece is shown having 12 slots, with six of the slots being used for the six expansion leaves. The other 6 slots act as stoppers to the six table top sections 140 that form the table top when in closed position, preventing the tip of a table top section from hitting the opposite table top section when the table top sections are pushed closed, thus avoiding damage to the tips of the table top sections. The stopping action occurs by means of interaction between one of the centerpiece slots 187 and a pin (not shown) located under the tip of the table top section located at a certain distance from the tip itself.

The panel 160 has an inner peripheral edge 202 and each of the inner leaf segments 166 have wedges 195 that bear against part of the peripheral edge of the panel during deployment, to guide the inner leaf segments on inclined paths toward the centerpiece 186. As seen in FIGS. 6A through 6E, the wedge 195 is mounted on inner segment 166 slightly radially outward of the peripheral edge 202 of the panel 160. The wedge has a shorter height at its inner end than its outer end, so that as the segment 169 moves to the right in the view of FIG. 6A, the wedge 195 can contact and slide over the peripheral edge 202, causing the elevation of the inner, pointed end 194 of the inner segment, so it can align with one of the slots 187 of the centerpiece 186.

The inner, pointed end 194 of the inner segment 166 of the expansion leaf has a downward-extending pin 197, preferably of brass, positioned so that the pin 197 of the inner segment 166 can fit into the radial slot 187 when the leaf is properly positioned in the deployed configuration. When the pointed end 194 approaches the centerpiece 186, the pin 197 slides into the slot 187, as seen in the progression of FIGS. 6A through 6E.

Deployment of the expansion leaves involves pulling the outer segment 168 of the expansion leaf upward and outward until it rests on outer skirt 204 that itself is supported on an outer peripheral edge of the panel. This pulling of the outer segment causes the pivoting of the outer segment 168 around the pins 170, until the expansion leaf is above the slot 172 in the rail 162, causing the expansion leaves to reach the same height as the table top sections. (See the progression in FIGS. 6A through 6E.) The inner, pointed end 194 of the expansion leaf is aimed toward the centerpiece 186 so the pin 197 on the underside of the inner segment can be lodged in the radial slot 187 of the centerpiece, preventing potentially damaging side-to-side movement of the pointed end 194. Each expansion leaf may also be guided by the rails 162 that adjoin it.

Figure 7:
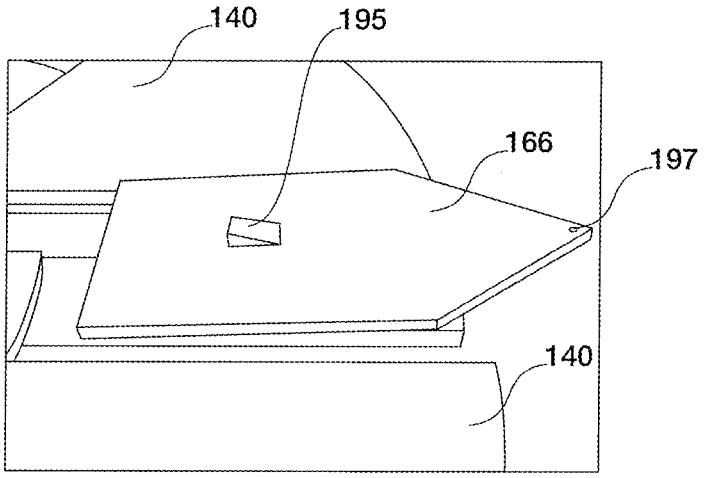
FIG. 7 is perspective view one side of the inner leaf segment.
Figure 8:
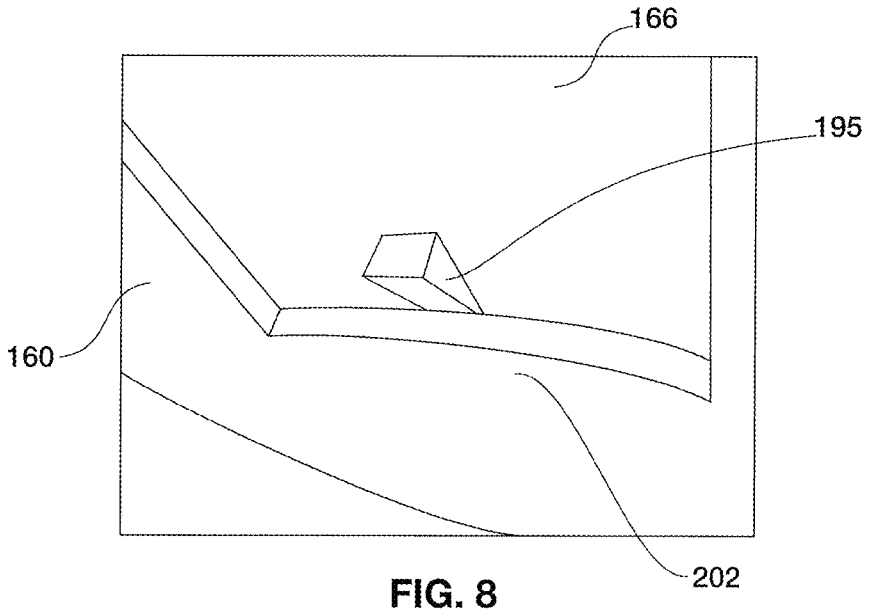
FIG. 8 is perspective view one side of the inner leaf segment as viewed from below the panel of the table.
Figure 9B:
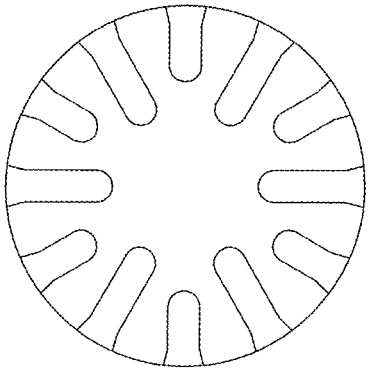
FIGS. 9A through 9C are perspective, top and side views, respectively of a centerpiece of the table in accordance with the invention.
Figure 9A:
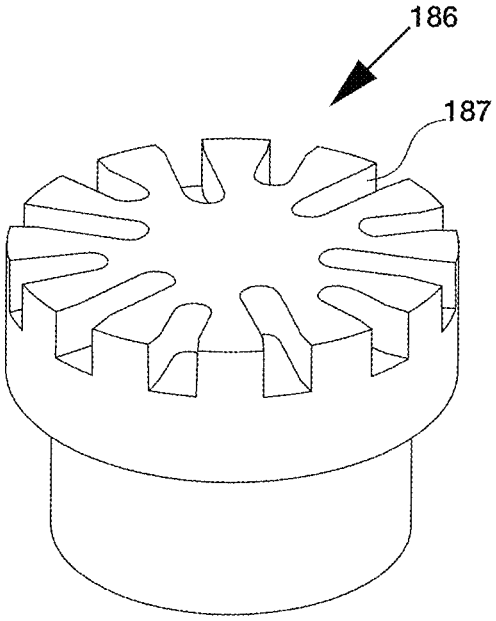
Figure 9C:
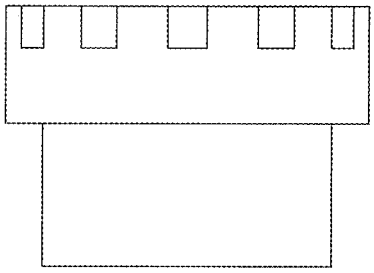

FIG. 7 shows the inner leaf segment 166 pivoted outward to the edge of the table (in a position it does not normally take in use) to show the wedge 195 and pin 197. FIG. 8 is a view from below the panel 160 showing the panel's inner peripheral edge 202 and the wedge 195 of the inner leaf segment 166.

The expansion leaves have a stored length when the expansion leaves are stored under the table top sections as the table top sections make a smaller, full table top (as seen in FIG. 10), and an installed length when the leaves are positioned coplanar to the table top sections, as seen in FIG. 11, the stored length being greater than the installed length.

Typically there are six of the table top sections and six expansion leaves, as shown, but other numbers of sections and other table top shapes can be used, as the Dodge patent shows in his FIGS. 11*a* through 14*c*.

CNC machining is useful to assure the correct shapes of the items described to enable the mechanism to work faultlessly.

Figure 13:
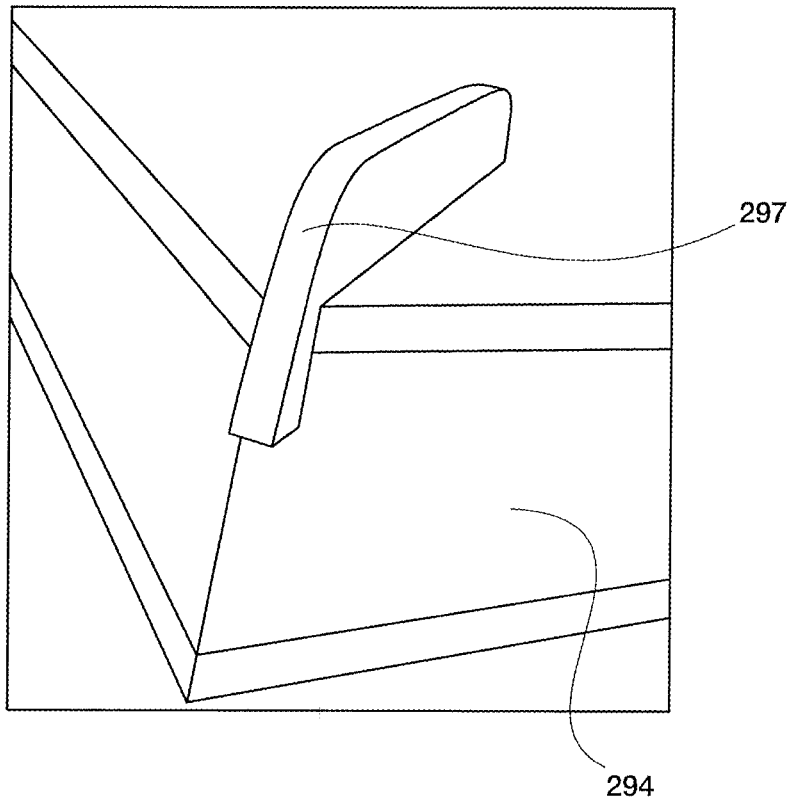
FIG. 13 is a perspective view of a tip or pointed end of an inner segment with another form of protrusion.

The pin 197 is an embodiment of a projection from the underside of the inner segment, and FIG. 13 shows another form of projection. FIG. 13 shows an embodiment that is constructed like the embodiment shown in FIGS. 6A through 12, with the modification of replacing the downward pin 197 with a flat sheet of material, such as a wood flange 297. The flange 297 is mounted in a groove at the point of the inner segment 294. When the expansion leaf is deployed, the wood flange enters a corresponding radial slot in a centerpiece, as in the embodiment shown in FIGS. 6A through 12. Flange 297 is an embodiment of a projection from the underside of the inner segment.

Figure 14:
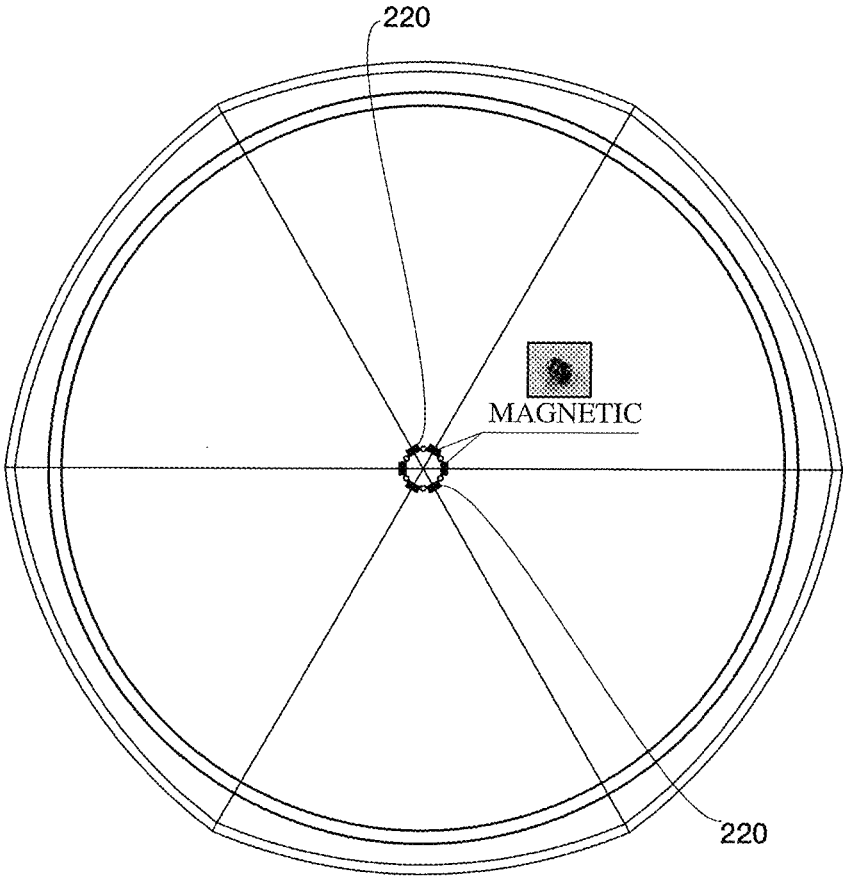
FIG. 14 is a top view of a table in accordance with another embodiment of the invention with the leaves folded inward.
Figure 15:
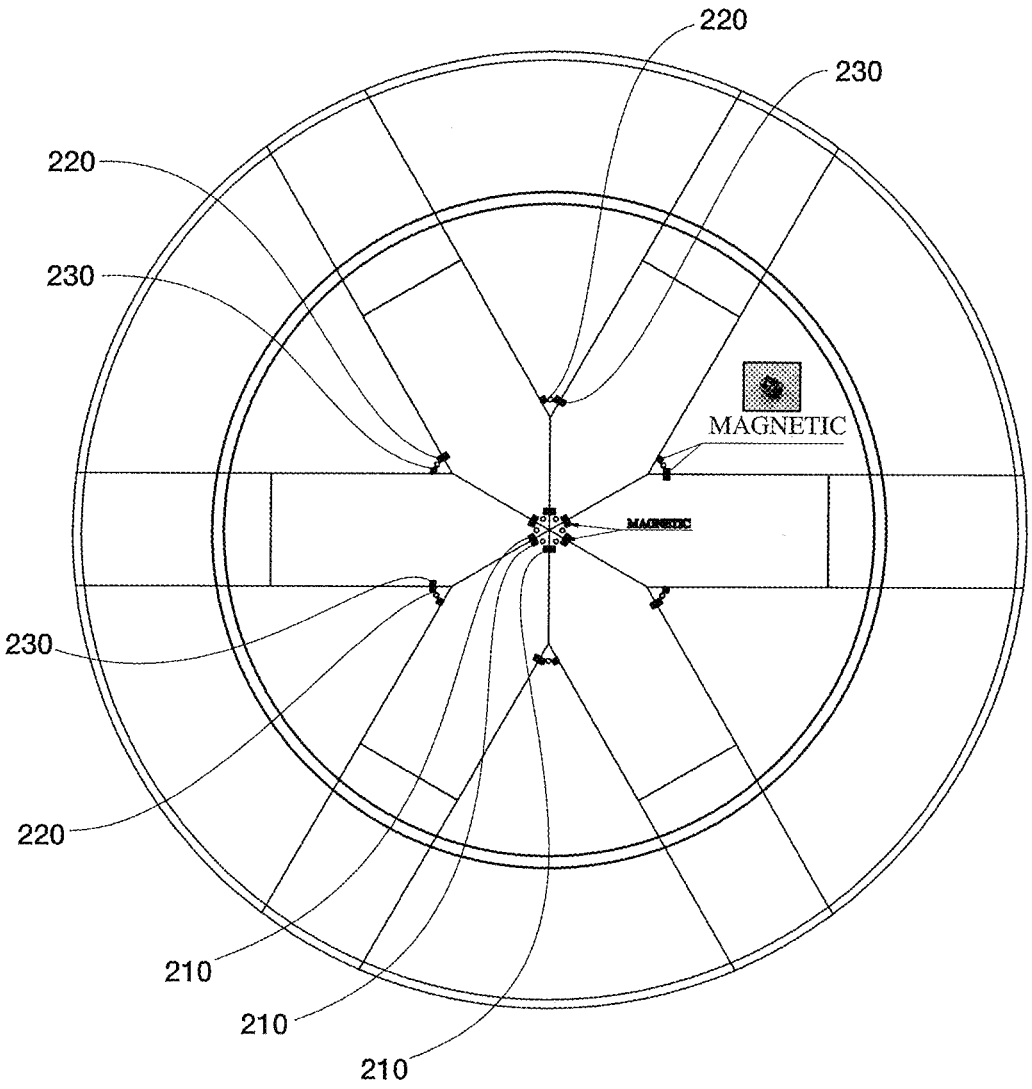
FIG. 15 is a top view of a table in accordance with the embodiment of FIG. 14 with the leaves folded outward.

In another embodiment as seen in FIGS. 14 and 15, magnets 210 can be mounted on the tips of the inner segments of the expansion leaves, so the tips are attracted to each other when the tips get in contact with each other, preventing loose movement of the expansion leaves when deployed. In addition similar magnet mountings 220 on the tips of the table top sections keep the table top sections well jointed together until enough force is exerted to radially pull the sections apart. Magnets may be mounted on both sides of the tips of table top sections and the tips of the inner segments of the expansion leaves, so they work with top closed position as well as expanded position. The magnets can be used on expansion leaves in combination with the pins 197 or the flanges 297. Additional magnets 230 on the sides of the inner segments of the expansion leaves can be located to be attracted to the magnets 220 of the table top sections, adding further cohesion of the table top sections and expansion leaves.

Certain modifications and improvements will occur to those skilled in the art upon reading the foregoing description. It should be understood that all such modifications and improvements have been omitted for the sake of conciseness and readability, but are properly within the scope of the following claims.

What is claimed is:

1. A table comprising:

a table base including a pedestal to rest on a floor, a panel of the table base defining a panel height, a plurality of table top sections mounted to the panel to enable radial movement of the table top sections from an inner position in which the plurality of table top sections are adjacent one another to make a full table top to an outer position spaced from one another, mounts on the panel that rise above the panel height to a mount height below the table top sections, each mount having a slot below the mount height, a plurality of expansion leaves that are unattached to one another, each formed of inner and outer leaf segments joined end-to-end by a hinge, so each expansion leaf has a folded configuration and a deployed configuration, the inner leaf segment of each expansion leaf having a pointed end away from the hinge, the pointed end having a downward-extending projection, two side edges of the outer leaf segment of the expansion leaf each having an outward-extending pin received in the slot of one of the mounts, and a table centerpiece on the panel having radial slots in its top, so that when the table top sections are moved to their outer positions, the expansion leaves may each be moved from their folded configuration to their deployed configuration by unfolding the outer leaf segment and pivoting it outward around the outward-extending pin and guiding the pointed end of the inner leaf segment toward the table centerpiece, and positioning the downward-extending projection in one of the radial slots in the table centerpiece.

2. A table as claimed in claim 1 wherein the table top sections mount to a rail on the panel.

3. A table as claimed in claim 1 wherein the table top sections mount to a channel on the panel.

4. A table as claimed in claim 1 wherein the expansion leaves have a stored length when the expansion leaves are stored under the table top sections as the table top sections make a smaller, full table top, and an installed length when the leaves are positioned coplanar to the table top sections, the stored length being greater than the installed length.

5. A table as claimed in claim 1 wherein the panel has an inner peripheral edge and each of the inner leaf segments have wedges that bear against the part of the inner peripheral edge of the panel to guide the inner leaf segments on inclined paths toward the centerpiece.

6. A table as claimed in claim 1 wherein the plurality of the table top sections equals six and the plurality of expansion leaves equals six.

7. A table as claimed in claim 1 wherein the mounts on the panel are stanchions.

8. A table as claimed in claim 1 wherein the panel has an inner peripheral edge and each of the inner leaf segments has a wedge positioned to bear against the peripheral edge of the panel to guide the inner leaf segment on an inclined path toward the centerpiece when the expansion leaves transition from the folded configuration to the deployed configuration.

9. A table as claimed in claim 1 wherein the downward-extending projection is a pin.

10. A table as claimed in claim 1 wherein the downward-extending projection is a flange.

11. A table as claimed in claim 1 wherein the pointed end of each inner leaf segment of each expansion leaf has magnets on its sides, so the pointed ends are attracted to one another when they are in their deployed configuration.

12. A table comprising:

a table base including a pedestal to rest on a floor, a panel of the table base defining a panel height, the panel having an inner peripheral outer edge, a plurality of table top sections mounted to the panel to enable radial movement of the table top sections from an inner position in which the plurality of table top sections become adjacent to make a smaller, full table top to an outer position spaced from one another, mounts on the panel that rise above the panel height to a mount height below the table top sections, each mount having a slot below the mount height, a table centerpiece on the panel, a plurality of expansion leaves that are unattached to one another, each formed of inner and outer leaf segments joined end-to-end by a hinge, so each expansion leaf has a folded configuration and a deployed configuration, two side edges of the outer leaf segment of the expansion leaf each having an outward-extending pin received in the slot of one of the mounts, the inner leaf segment of each expansion leaf having a wedge positioned to bear against part of the inner peripheral edge of the panel to guide the inner leaf segment on an inclined path toward the centerpiece, so that when the table top sections are moved to their outer positions, the expansion leaves may each be moved from the their folded configuration to their deployed configuration by unfolding the outer leaf segment and pivoting it outward around the outward-extending pins and guiding the pointed end of the inner leaf segment toward the table centerpiece including affecting the trajectory of the inner leaf by contact between the wedge and the inner peripheral edge of the panel, and supporting an innermost end of the inner leaf segment on the centerpiece.

13. A table as claimed in claim 12 wherein the table top sections mount to a rail on the panel.

14. A table as claimed in claim 12 wherein the table top sections mount to a channel on the panel.

15. A table as claimed in claim 12 wherein the mounts on the panel are stanchions.

16. A table as claimed in claim 12 wherein the expansion leaves have a stored length when the expansion leaves are stored under the table top sections as the table top sections make a smaller, full table top, and an installed length when the leaves are positioned coplanar to the table top sections, the stored length being greater than the installed length.

17. A table as claimed in claim 12 wherein plurality of the table top sections equals six and the plurality of expansion leaves equals six.

18. A table as claimed in claim 12 wherein the pointed end of each inner leaf segment of each expansion leaf has magnets on its sides, so the pointed ends are attracted to one another when they are in their deployed configuration.

19. A table comprising:

a table base including a pedestal to rest on a floor, a panel of the table base and defining a panel height, the panel having an inner peripheral edge, six table top sections mounted to the panel to enable radial movement of the table top sections from an inner position in which the six table top sections become adjacent to make a smaller, full table top to an outer position in which the six table top sections are spaced from one another, rails on the panel that rise above the panel height to a rail height below the table top sections, each rail having a slot below the rail height, a table centerpiece on the panel having radial slots in its top, six expansion leaves that are unattached to one another, each formed of inner and outer leaf segments joined end-to-end by a hinge, so each expansion leaf has a folded configuration and a deployed configuration, the inner leaf segment of each expansion leaf having a pointed end away from the hinge, the pointed end having a downward-extending pin and a wedge positioned to bear against the inner peripheral edge of the panel to guide the inner leaf segment on an inclined path toward the centerpiece when the expansion leaves transition from the folded configuration to the deployed configuration, two side edges of the outer leaf segment of the each expansion leaf each having an outward-extending pin received in the slot of one of the rails, and wherein the expansion leaves have a stored length when the expansion leaves are stored under the table top sections as the table top sections make a full table top, and an installed length when the leaves are positioned coplanar to the table top sections, the stored length being greater than the installed length, so that when the table top sections are moved to their outer positions, the expansion leaves may each be moved from the their folded configuration to their deployed configuration by unfolding the outer leaf segment and pivoting it outward around the outward-extending pin and guiding the pointed end of the inner leaf segment toward the table centerpiece, and as the expansion leaves transition from the folded configuration to the deployed configuration, the wedge bears against the inner peripheral edge of the panel to guide the inner leaf segment on an inclined path toward the centerpiece and the downward-extending pin is positioned into one of the radial slots in the table centerpiece.

* * * * *